US005981004A

United States Patent [19]

Kostic

[11] Patent Number: 5,981,004

[45] Date of Patent: Nov. 9, 1999

[54] DECORATIVE AQUATIC ANIMAL REPLICA DEVICE

[76] Inventor: David C. Kostic, 9797 S. Dampler Way, Highlands Ranch, Colo. 80126

[21] Appl. No.: 09/061,532

[22] Filed: Apr. 15, 1998

[51] Int. Cl.[6] ..... G09F 19/00

[52] U.S. Cl. ..... 428/16; 428/542.2

[58] Field of Search ..... 428/68, 16, 542.4, 428/542.2; 119/256, 253; 434/296

[56] References Cited

FOREIGN PATENT DOCUMENTS 2017591 10/1979 United Kingdom .

*Primary Examiner*—Alexander Thomas

*Attorney, Agent, or Firm*—Lee G. Meyer; Patton Boggs, LLP

[57] ABSTRACT

A replica of a fish or other aquatic animal, capable of placement into indoor and outdoor fish ponds, with or without fountain current flow, with no overhanging or suspension member provided. An aquatic or marine animal replica, and preferably a Koi fish, is supported on an adjustable rod which supportedly communicates with a stand member having a reservoir therein to accept a clear ballasting liquid. The support shaft is telescopically adjustable.

5 Claims, 1 Drawing Sheet

DECORATIVE AQUATIC ANIMAL REPLICA DEVICE

BACKGROUND OF THE INVENTION

1. Field of the Invention

This invention relates to aquatic and marine replication display devices and more specifically to artificial devices that simulate aquatic animals for use in indoor and outdoor decorative ponds, fountains and the like.

2. Related Art

Fishes and aquatic life, especially tropical aquatic life have long been cultivated by man in aquariums. These aquariums can be from the size slightly bigger than a fish bowl to large, million gallon habitations occupying many square feet and even whole rooms. It has long been recognized that an aquarium can not only be decorative but relaxing, giving the viewer a sense of peacefulness and tranquility.

One type of aquarium is a "fish pond". It has long been accepted that it is a possession of beauty and even prestige to have indoor or outdoor fish ponds. The ancients in fact bred a specific breed of fish called a Koi, which resembles a large goldfish, to populate these ponds. These fish ponds can contain fountains or the like and be architecturally placed into the structure of, for example, a building or a home. One popular placement is in commercial atriums or domestic outdoor fountains. Although the aquatic life that populate these ponds are beautiful, they are difficult to maintain. As live animals, their environment must be regulated constantly to provide life supporting surroundings. These fish, and especially Koi fish, are extremely expensive with those of a size about that of a large trout running over $3,000. In colder climes where temperatures dip even in the warmer months, it is very difficult to maintain temperatures in these ponds to allow these aquatic life to survive. These fish, of course, have to be maintained and fed on a regular basis adding to the expense. These ponds tend to have other problems relating to fungi, bacteria, algae and the like which make maintaining the ponds with the live animals, and especially Koi, particularly difficult. This is especially true with fountains and other water pumping devices which are particularly sensitive to algae and other bacterial buildup. For example, one treatment for algae or bacterial buildup is to pour household bleach or chlorine into the water to kill the algae. This of course will also kill fish, if they are present.

There has been much attempted in the prior art to obtain the aesthetic aspects of having these beautiful aquatic animals present, yet not having the live animals. Various strings and ropes and other kinds of devices have been devised to mask the fact that the animals are, in fact, artificial. The problem with using strings or other kind of suspension devices in outdoor and indoor ponds, is that there is no wall to support the suspension devices. For example, U.S. Pat. No. 4,588,618, D-294,129 and D-287,110 teach artificial fish suspended to make it look like fish are in the water. U.S. Pat. No. 4,550,518 and 3,186,120 teach fish decoys that give the illusion that fish are in the water. U.S. Pat. No. 3,975,845; D-327 142; D-289 023; and, D-289 022 disclose artificial fish.

Many of the prior art devices employ suspension media that are visible or do not allow the adjustment of the device in the aquarium or pond. Thus, it would be advantageous to have an aquatic animal which was able to be placed in substantially any pond irrespective of the water flow and currents yet appear to be lifelike without the appearance of the stand or other supporting member to the naked eye, but without the requirement for suspension of the aquatic animal on overhanging members walls or the like.

SUMMARY OF THE INVENTION

It is now been discovered that an artificial replica of a fish or other aquatic animal is capable of placement into indoor and outdoor fish ponds, with or without fountain current flow, with no overhanging or suspension member. In accordance with the invention, an aquatic or marine animal replica, and preferably a Koi fish, is supported on an adjustable rod which supportedly communicates with a stand member having a reservoir therein to accept a clear ballasting liquid.

In one embodiment the support shaft is telescopically adjustable. In another embodiment, is capable of being configured to the desired height. In accordance with the preferred embodiment, the stand is substantially rectangular and underlies substantially the entire area of the aquatic animal being supported.

DETAILED DESCRIPTION OF THE DRAWING

Figure 1:
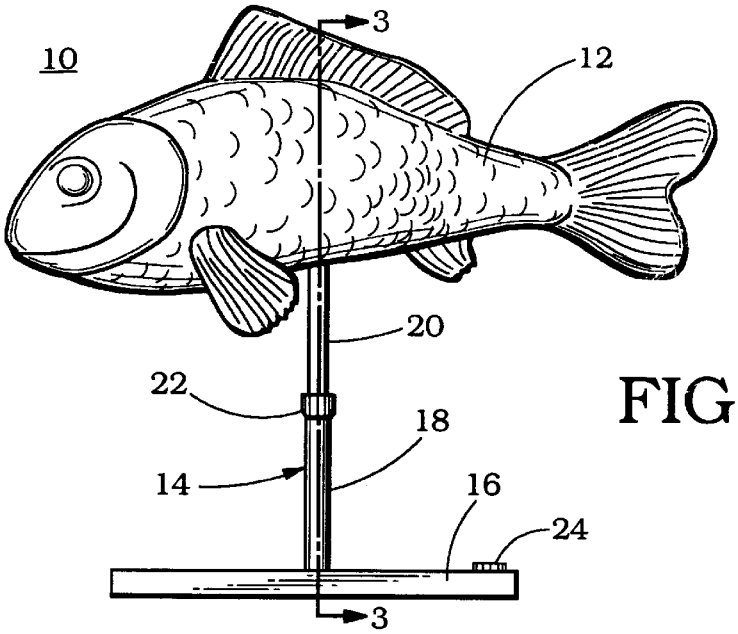
FIG. 1 is a side perspective view of a Koi fish supported on a stand in accordance with the instant invention.

FIG. 1 shows the decorative aquatic animal replica device for placing in a fish pond or the like in accordance with the instant invention. An aquatic replica device 10 has an aquatic animal replica 12 removably supported on an upstanding adjustable shaft 14 which is in turn supported on a stand 16. Preferably the material of the upstanding adjustable shaft 14 and the stand 16 is clear, to avoid detection when the aquatic replica device 10 is placed into a pond, fountain or the like.

Upstanding adjustable shaft 14 has a housing portion 18 and a telescoping portion 20. As better seen in FIG. 3, the housing portion 18 has a diameter slightly larger than telescoping portion 20 so that telescoping portion 20 slidably fits within housing portion 18. A beveled friction nut 22 has a female threaded portion 28 which engages a male threaded portion 30 on housing 18 as better seen in FIG. 4.

Stand 16 contains a capped, fill spout 24 through which cavity 32 is filled with a ballasting fluid 34. As better shown in FIG. 3, the cavity 32 is preferably substantially the total volume of stand 16. The aquatic animal replica 12 has an orifice 26 in the body thereof adapted to frictionally accept telescoping portion 20. Thus, the device can be disassembled for shipping or a longer (shorter) telescoping portion 20 can be used.

Figure 2:
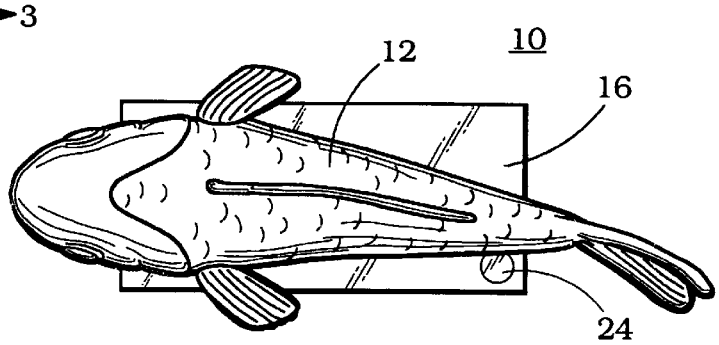
FIG. 2 is a top, perspective view of the fish in FIG. 1.

As better shown in FIG. 2, the aquatic animal replica 12 is substantially placed in the center of the stand 16 and stand 16 is preferably rectangular to support both the width and the length of the aquatic animal replica 12. It will be realized that the exact shape of the stand is not important to the invention and that it will be evident to those of ordinary skill in the art, that the surface area of the bottom of the stand must be sufficient to support the aquatic animal replica 12.

In operation, telescoping portion 20 is inserted into orifice 26 in the body of aquatic replica animal 12. The beveled friction nut 22 is loosened and telescoping portion 20 is slidably moved within housing 18 to the desired height. Beveled friction nut 22 is then hand tightened to secure telescoping portion 20 in position with respect to housing 18. Filler cap 24 is removed and a ballasting liquid 34 poured into the cavity 32 within stand 16. The filler cap 24 is then replaced. The liquid, which is preferably clear or light blue or of a color that is the same as the bottom of the pond, has a specific gravity that is greater than water i.e. greater than 1, to act as a ballast to hold the aquatic replica device 10 on the bottom of the pond.

Figure 3:
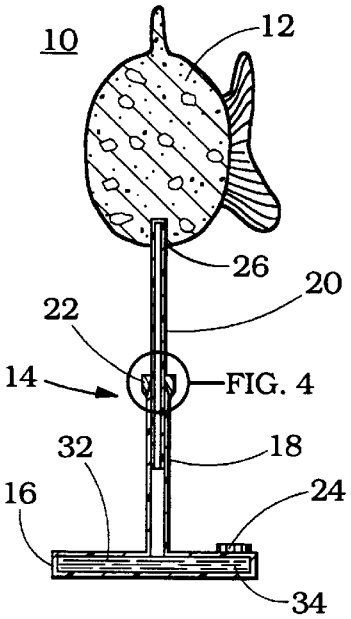
FIG. 3 is a cross section through lines 3—3 of FIG. 1 showing the ballast chamber within the stand.
Figure 4:
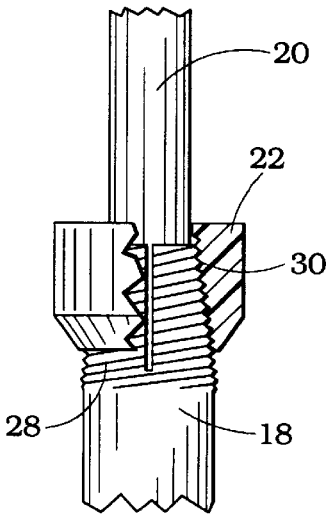
FIG. 4 cut away view of the highlighted portion of FIG. 3.

In accordance with the invention the replica can be formed of an appropriate material to present an esthetically pleasing figure. Preferably, the replica is solid (as shown in FIG. 3) to minimize buoyancy. In another embodiment the stand can be solid depending upon the buoyancy of the device 10. The support rods and stand are preferably of a clear material or of a color that masks their existence when viewed through water. In accordance with another embodiment, the stand can contain a friction orifice to accept the end of telescoping portion 20 in a manner similar to the configuration using orifice 26. In this embodiment the length of the shaft is adjusted by cutting telescoping portion 20 to the desired length prior to insertion into the replica and the stand.

What is claimed is:

1. An artificial aquatic animal replica device comprising:

a.) an aquatic animal replica;

b.) an upstanding shaft member which is substantially invisible to the observer in supportable communication with said aquatic animal replica; and, c.) a stand member in supportable communication with said upstanding shaft member which is substantially invisible to the observer.

2. The device of claim 1 further comprising a reservoir in said stand to accept a non discernable liquid to provide ballast to the device.

3. The device of claim 1 wherein said upstanding shaft member is adjustable.

4. The device of claim 3 wherein said upstanding shaft member comprises a shaft adapted for supporting engagement with said animal replication; a housing having a diameter slightly larger than shaft such that said shaft slidably fits within said housing portion; a friction engaging means for frictionally engaging said shaft within said housing.

5. The device of claim 1 wherein said aquatic animal replica is a Koi fish.

* * * * *